US007021025B2

(12) United States Patent
Romagnoli

(10) Patent No.: US 7,021,025 B2
(45) Date of Patent: Apr. 4, 2006

(54) FILTER BAG FOR CONTAINING A SUBSTANCE FOR INFUSION WITH THE GATHERED THREAD ATTACHED TO THE PICK UP TAG AND THE METHOD FOR PRODUCING THE BAG

(75) Inventor: Andrea Romagnoli, Castenaso (IT)

(73) Assignee: Tecnomeccanica S.r.l., Bologna (IT)

( * ) Notice: Subject to any disclaimer, the term of this patent is extended or adjusted under 35 U.S.C. 154(b) by 0 days.

(21) Appl. No.: 10/780,958

(22) Filed: Feb. 18, 2004

(65) Prior Publication Data

US 2004/0161497 A1 Aug. 19, 2004

Related U.S. Application Data

(62) Division of application No. 10/341,570, filed on Jan. 13, 2003.

(30) Foreign Application Priority Data

Jan. 11, 2002 (IT) ..... BO2002A0013

(51) Int. Cl.
*B65B 61/14* (2006.01)
*B65B 9/06* (2006.01)

(52) U.S. Cl. ..... 53/413; 53/450; 53/134.2

(58) Field of Classification Search ..... 53/413, 53/450, 134.2; 156/176, 297; 426/82, 83; 493/375

See application file for complete search history.

(56) References Cited

U.S. PATENT DOCUMENTS 2,468,464 A * 4/1949 Salfisberg ..... 426/83

(Continued)

FOREIGN PATENT DOCUMENTS

DE 2850604 * 7/1979

(Continued)

OTHER PUBLICATIONS

European Search Report dated Decembver 29, 2003, corresponding to European Application No. EP 02 42 5781.

*Primary Examiner*—John Sipos
(74) *Attorney, Agent, or Firm*—Fay, Sharpe, Fagan, Minnich & McKee, LLP

(57) ABSTRACT

A filter bag for containing a substance for infusion in a liquid comprises: a containment chamber with compartments for doses of the substance, sealed by top and bottom joins; a tag for picking up the bag; and a section of thread, wound around the outside of the containment chamber and extending along an outline of the chamber, one end of the thread being connected to the pick-up tag and the other to the top of the containment chamber. The section of thread is longer than the outline of the containment chamber to which it is attached. The excess length of the section of thread relative to the outline of the chamber is gathered on the outside of the containment chamber for the substance for infusion and is attached to the pick-up tag. A method for production of the filter bag is also part of the invention.

14 Claims, 4 Drawing Sheets

U.S. PATENT DOCUMENTS

| | | | | | |
|---|---|---|---|---|---|
| 2,490,057 | A | * | 12/1949 | Irmscher | 53/413 |
| 2,852,389 | A | * | 9/1958 | Johnson | 426/83 |
| 2,869,718 | A | * | 1/1959 | Whelan | 426/83 |
| 4,828,851 | A | * | 5/1989 | Romagnoli | 426/83 |
| 5,399,224 | A | * | 3/1995 | Vernon et al. | 53/134.2 |
| 5,580,408 | A | * | 12/1996 | Vernon et al. | 156/176 |
| 5,871,789 | A | * | 2/1999 | Romagnoli | 426/83 |
| 6,389,781 | B1 | * | 5/2002 | Ghirlandi | 53/413 |

FOREIGN PATENT DOCUMENTS

| | | | |
|---|---|---|---|
| EP | 0 806 352 | | 11/1997 |
| EP | 1002741 | * | 6/1998 |
| EP | 1016599 | * | 12/1998 |
| EP | 1 016 599 | | 7/2000 |
| EP | 1 223 110 | | 7/2002 |
| GB | 962 038 | | 6/1964 |
| GB | 2 052 428 | | 1/1981 |
| GB | 2052428 | * | 1/1981 |
| GB | 2 333 764 | | 8/1999 |
| WO | WO99/21762 | * | 5/1999 |

* cited by examiner 1
2
3
4
5
6
7
8
9a
9b
10
11
12a
12b
13
14
15
16
22
35
36a
36b
37
38

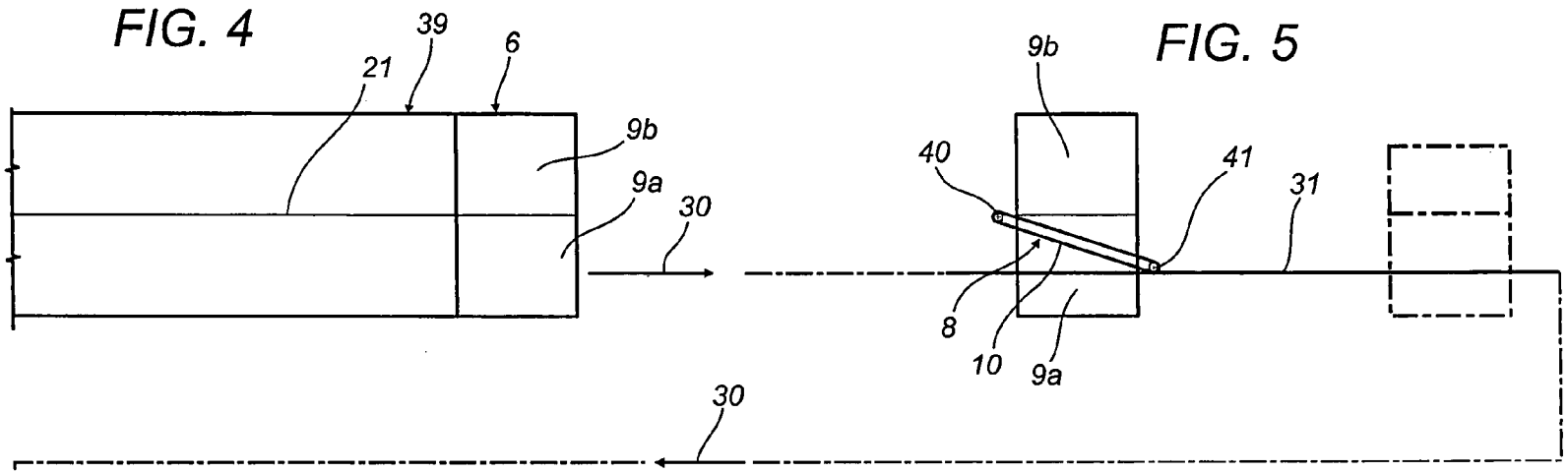
FIG. 4
FIG. 5
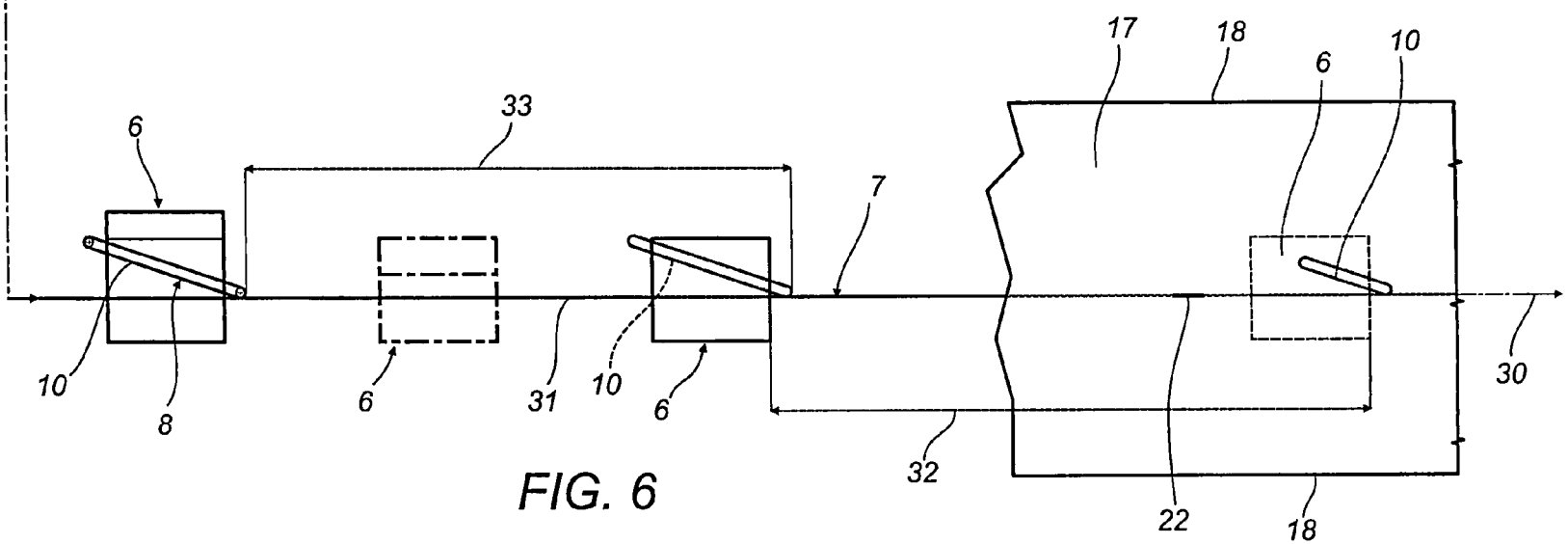
FIG. 6

FILTER BAG FOR CONTAINING A SUBSTANCE FOR INFUSION WITH THE GATHERED THREAD ATTACHED TO THE PICK UP TAG AND THE METHOD FOR PRODUCING THE BAG

This application is a division of 10/341,570 filed Jan. 13, 2003.

BACKGROUND OF THE INVENTION

The present invention relates to the automatic packaging of a substance for infusion, such as tea, chamomile, or similar herbal products, in paper filter bags, designed to be immersed in a liquid to prepare the infusion. In particular, the present invention relates to a filter bag with a special structure and the method for its production.

Recent market research has highlighted renewed interest in filter paper bags with a containment chamber which has two compartments, also known as two-lobed filter bags, made by heat-sealing. The filter bag is obtained by folding the filter paper then sealing the folds obtained in this way, using heat to activate a layer of glue spread on the paper web during one of the production steps.

However, filter bags made of heat-sealable filter paper using the conventional method are heavier than bags of the same size and shape in which the chambers which hold the doses of product are obtained by folding alone.

Since the cost of the paper is proportional to its weight, the greater weight of the bags made of heat-sealable filter paper means that, all other conditions being equal, they are more expensive than those made using folding alone. Since they are products with a low absolute weight, even a weight which is just a few grams higher has a significant percentage effect on the overall cost of the bag. To make bags made of heat-sealed paper economically competitive with bags made using folding alone, it is common practice to give the bags made of heat-sealed paper smaller overall dimensions than those of the corresponding bags made of folded paper.

When the bag made of heat-sealed paper is made with the pick-up tag connecting thread wound around the bag and precisely as long as the outline of the bag, the latter's reduced dimensions mean that the working length of the thread available is shorter.

If the infusion is prepared in certain types of tea-pots or in particularly tall cups or glasses, said thread length may be insufficient to prevent the tag from accidentally slipping over the edge of the infusion container during infusion and falling into the infusion liquid, with obvious consequences in terms of hygiene and/or pick-up tag recovery.

Moreover, bags made of heat-sealed paper using the known method, at the production step also involve the use of a blob of adhesive—normally Mylar®, which, attached to the thread and the bag, allows them to be held together in a compact structure, preventing the tag from dangling freely from the bag.

The material used for the blob of adhesive has its own cost, which disadvantageously increases the overall cost of the filter bag. Other costs are also related to the complex construction of the packaging machines which require a purpose-designed unit for the adhesive for the bag.

SUMMARY OF THE INVENTION

The main aim of the present invention is to overcome the aforementioned disadvantages by providing a bag made of heat-sealable paper which is designed in such a way that it has a section of connecting thread whose length is not related to the length of the outline of the filter bag.

Another aim of the present invention is to eliminate the need for Mylar, making the filter bag even more economical and the equipment used to make it less complex and expensive.

According to the invention, these and other aims are fulfilled by a filter bag for containing a substance for infusion in a liquid comprising a containment chamber, with at least one compartment for holding a dose of the substance which is sealed by top and bottom joins; a tag for picking up the bag; and a section of thread, wound around the outside of the containment chamber and extending along an outline, one end of the thread being connected to the pick-up tag and the other end connected to the top of the containment chamber, and wherein the section of thread is longer than the outline of the containment chamber to which it is attached, the excess length of the section of thread relative to said outline being gathered on the outside of the containment chamber for the substance for infusion. The present invention also refers to a method for producing the bag.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment of the invention without limiting the scope of the inventive concept, and in which:

FIG. 1 is an enlarged side assembly view of a bag made in accordance with the present invention;

FIG. 2 is a front view of the bag illustrated in. FIG. 1;

FIG. 3 is a detail of the bag illustrated in FIG. 1 seen from the side opposite that in FIG. 2;

FIGS. 4 through 13 are schematic views of the succession of steps embodying the method for production of the bag illustrated in FIGS. 1–3.

DESCRIPTION OF THE PREFERRED EMBODIMENTS

Figures 1, 2, 3:
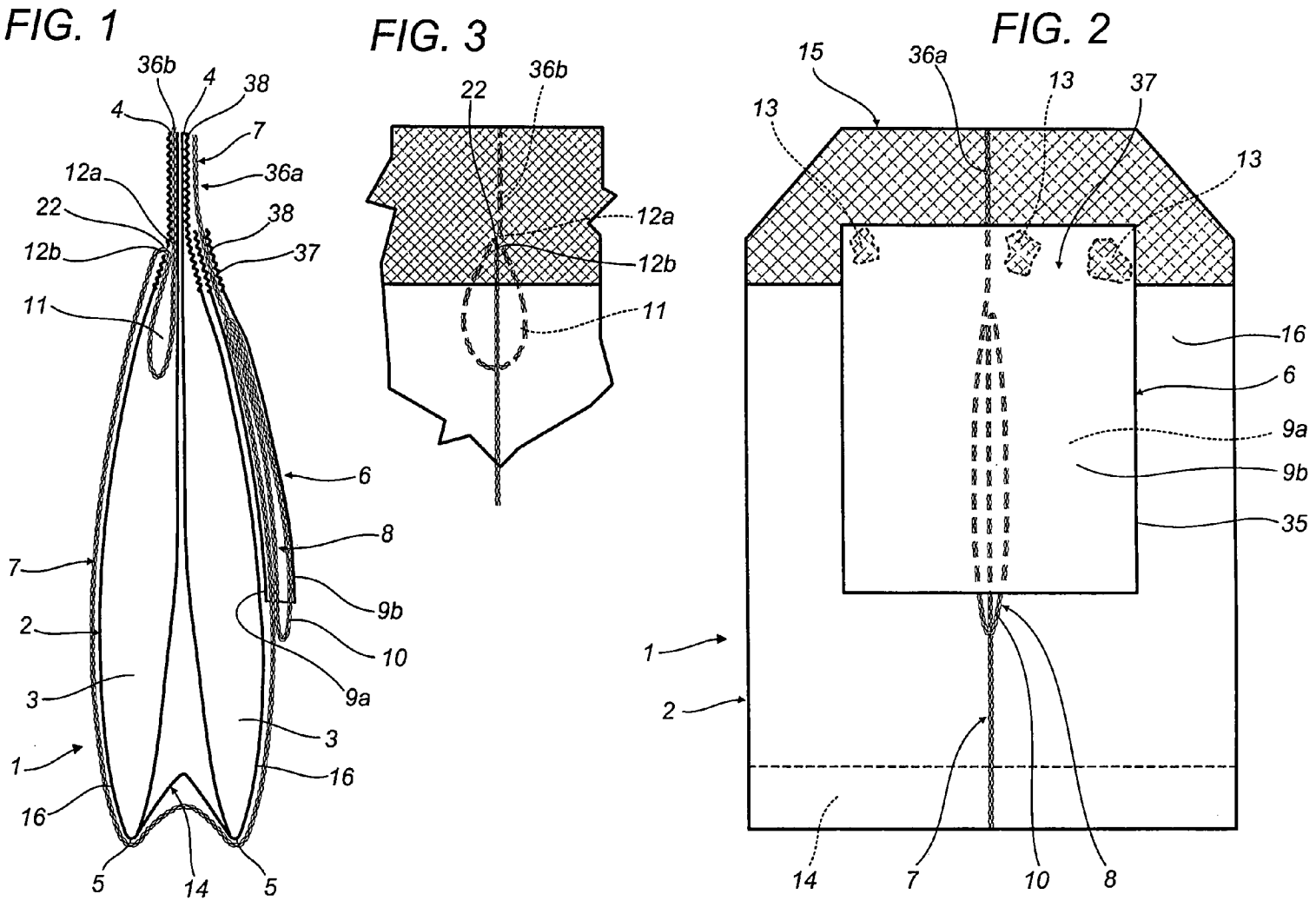

With reference to the accompanying drawings, FIG. 1 illustrates as a whole a filter bag 1 for containing a substance for infusion in a liquid, such as tea, chamomile or other herbal products, which basically comprises a chamber 2 for containing the substance and a tag 6 for manually picking up and holding the containment chamber 2 during infusion, connected to one another by a section of thread 7.

The containment chamber 2 has two separate compartments 3 for doses of the substance, which are connected to one another at a top join 4 and a bottom join 5.

The compartments 3 are set opposite one another, overlap and are connected by a folded base 14 which is "V"-shaped, with the narrow base of the V pointing upwards towards the inside of the containment chamber 2.

The section of thread 7 is wrapped around the outside of the containment chamber 2. It extends along an outline of the chamber and one end of the thread is connected to the pick-up tag 6, whilst the other end is connected to the top 15 of the containment chamber 2.

The section of thread 7 is longer than the outer outline of the containment chamber 2 to which it is attached. The excess length 8 of thread 7 relative to the length of the outline is looser than the rest of the section of thread 7 which, in contrast, is pulled taut along the outline of the containment chamber 2 and is gathered, on the outside of the containment chamber 2 for the substance for infusion, in the form of one or more first winding loops 10 attached to the pick-up tag 6.

This is clearly visible in FIGS. 1 and 2 which illustrate in particular that the pick-up tag 6 includes two flaps 9*a, b*, folded over one another by rotation about a shared edge 35, parallel with the section of thread 7 wound around the outline of the bag 1. The excess length 8 of the section of thread 7 is held between these flaps 9*a, b*.

The pick-up tag 6 preferably has a layer of adhesive material on the faces of the flaps 9*a* and *b* facing the excess length 8 of thread, which can be activated by suitable heat, so that the flaps 9*a, b* of the tag 6 stick together and hold the excess length 8 of the section of thread 7 there gathered tightly and in an orderly fashion. This hold, sufficient to prevent any change in the state of the package during handling, is removable and can be overcome by applying a small amount of pulling force to the section of thread 7 outside the tag 6 to unwind the first loop(s) 10 and allow the consequent extraction of the excess length 8 of thread from the bag 1 pick-up tag 6.

The fixing to the tag 6 of the free end 36*a* of the section of thread 7 adjacent to the excess length 8 is achieved by passing it through and sealing flaps 37 of the tag 6 transversally to the section of thread 7. The flaps 37 are connected internally by a sealing bead 38 and the free end 36*a* of the section of thread projects from them towards the top 15 of the bag 1.

FIG. 2 also shows how the pick-up tag 6 is connected to the side wall 16 of the containment chamber 2 by a seal—labeled 13—also obtained using a layer of heat-activated adhesive on one of the faces of the flap 9*a* of the tag 6 flaps 9*a* and *b*, that is, the one facing the containment chamber 2.

The section of thread 7 also comprises a second loop 11, housed in the compartment 3 of the containment chamber 2 opposite and separate from the compartment 3 contiguous with the tag 6. This second loop 11 has diverging ends 12*a*, 12*b* which project from the compartment 3. One end 12*a* goes towards the top 15, the other 12*b* towards the bottom 14 of the containment chamber 2. The end 12*a* which goes towards the top 15 is gripped and secured between opposite faces of the compartment 3 which are sealed together to form the top join 4—by heat activation of a layer of adhesive on the filter paper of which the walls of the compartment are made. The end 12*b* which goes towards the bottom 14 of the chamber projects through the side wall 16 opposite that on which the tag 6 is fixed, at a convenient slit 22 in the side wall 16.

Since, as illustrated in FIG. 3, the ends 12*a*, 12*b* of the second loop 11 are moved relative to one another transversally to the section of thread 7, pulling the section of thread 7 connected to the ends 12*a* and 12*b* wrinkles the top 15 of the containment chamber 2, guaranteeing that the section of thread 7 is secured to the top 15.

Therefore, in the filter bag 1 described above, the ends 36*a* and 36*b* of the section of thread 7 are secured to the top 15 of the containment chamber 2 at the two top joins 4 which also seal the two separate containment chamber 2 compartments 3.

The aforementioned filter bag 1 is used for conventional infusion by manually picking up the tag 6 with the containment chamber 2 suspended from it. However, the presence of the excess length 8 of thread gathered between the pick-up tag 6 flaps 9*a* and *b* allows a change at the user's discretion in the actual distance between the tag 6 and the top 15 of the bag 1, so that on each occasion the length of the section of thread 7 can be made compatible with the different sizes of cups or glasses in which the infusion is prepared. This is all possible without the risk of the pick-up tag 6 accidentally falling into the infusion liquid.

FIGS. 4 to 13 schematically illustrate the operating sequence consisting of the succession of steps for production of the filter bag 1 disclosed.

With references to these figures, firstly it must be said that the production process involves the steps of feeding only three packaging materials along a predetermined feed direction 30 and parallel with one another in a suitable sequence. These materials consist of a filter paper web 17 with a layer of heat-activated adhesive, a cotton thread 31 positioned longitudinally and opposite the filter paper web 17, and a tag paper web 39, from which a set of tags 6 is made in succession which are positioned along the filter paper web 17 at predetermined intervals 32.

FIG. 4 shows how the tag paper web 39 being fed in the feed direction 30 is first creased lengthways along the middle of it in order to create on the web 39 a line 21 that can facilitate folding of the web 39. Next, the paper web 39 is cut transversally, to form tags 6 with two separate coplanar flaps 9*a, b*, separated from one another by the fold line 21.

After the tag 6 has been cut and positioned relative to the thread 31, as illustrated in FIG. 5, the process involves the step of forming on the thread 31 and with the aid of suitable fork means 40, one or more first winding loops 10 gathered in succession one on top of another and designed to form a sort of hank of thread 31 positioned in front of one 9*a* of the tag 6 open flaps 9*a* and *b*.

In a subsequent step, schematically illustrated on the left of FIG. 6, the flap b of the tag 6 which is not in contact with the hank of thread 31, is gradually folded about the fold line 21 and brought into position overlapping the other tag 6 flap 9*a*. It is then sealed by heat-activation of the layer of adhesive material which, after folding, the two faces 9*a* and *b* of the tag 6 hold opposite one another.

At this point, with reference to the right-hand side of FIG. 6, the filter paper web 17—which in the figure appears to be on top of the thread 31 with the tags attached—is cut in such a way as to make a slit 22 in the paper.

Figure 7:
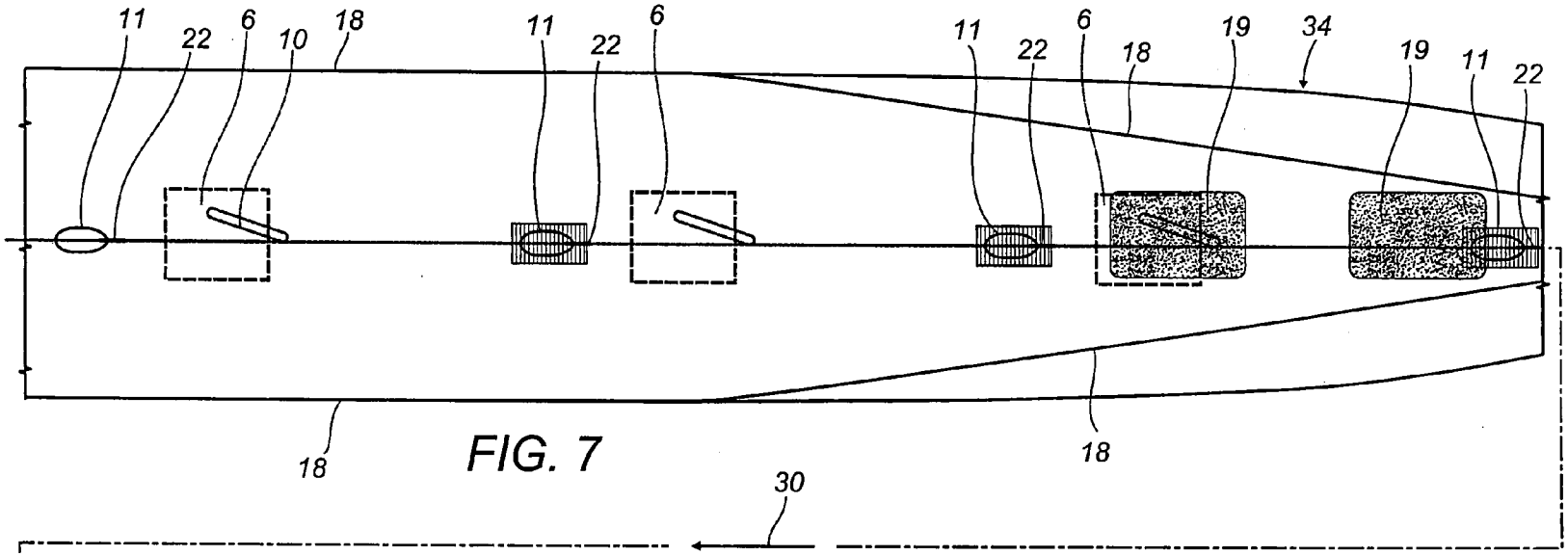

The thread 31 is forced to pass through the slit 22—on the left of FIG. 7—over the filter paper web 17 to form the second loop 11. During the following step, the loop 11 may be tightly secured to the filter paper by sealing, thanks to conveniently localized heat re-activation of the layer of adhesive material on the filter paper.

During the same operation a seal may also be made which attaches the filter paper to the tag 6 below, including the hank of thread.

Then, as shown on the right-hand side of FIG. 7, the process involves the steps of winding the filter paper web 17 over itself so that the edges 18 initially opposite one another are overlapping, to gradually form a filter paper tube 34 with the loop 11 inside its internal concave area. Then, before the tube 34 is definitively formed, two doses 19 of the substance for infusion are deposited on the web 17 one after another.

Figure 8:
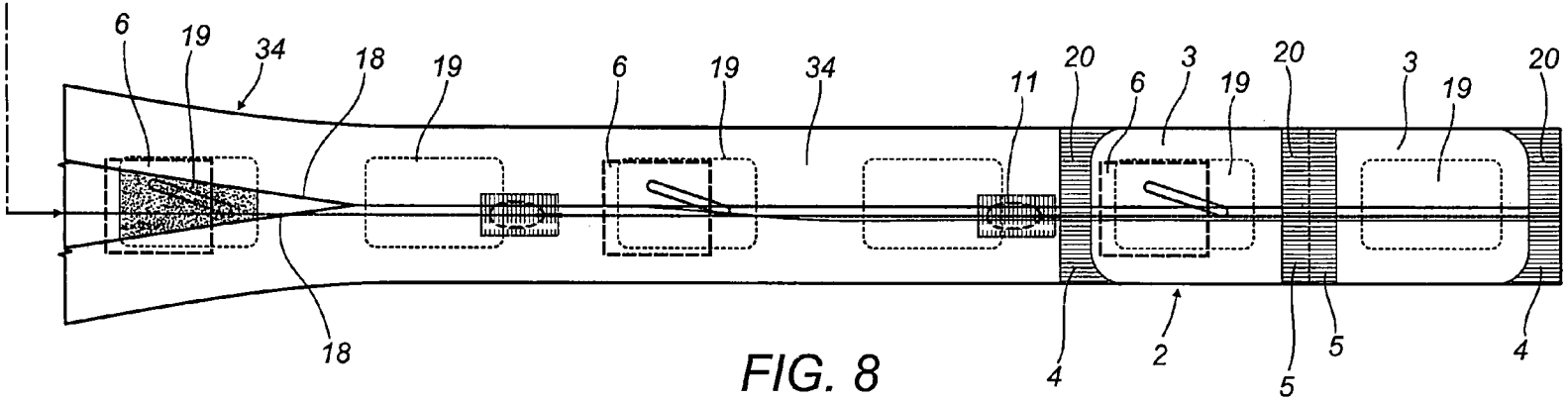

When the edges 18, schematically illustrated on the left and at the center of FIG. 8, are completely overlapping, the process involves the step of connecting the longitudinal edges 18 of the tube 34 to one another by sealing, by heat activation of the layer of adhesive material on the filter paper.

During a subsequent step, illustrated on the right of FIG. 8, the tube 34 is divided into separate compartments 3, each containing a dose 19 of the substance for infusion. The compartments 3 are created by making pairs of sealed transversal connections 20, respectively upstream and downstream of the tag 6. More specifically, these connections form the top join 4 and the bottom join 5 which seal the compartments 3, also securing the thread 31 to the filter bag 1 containment chamber 2.

Figure 9:
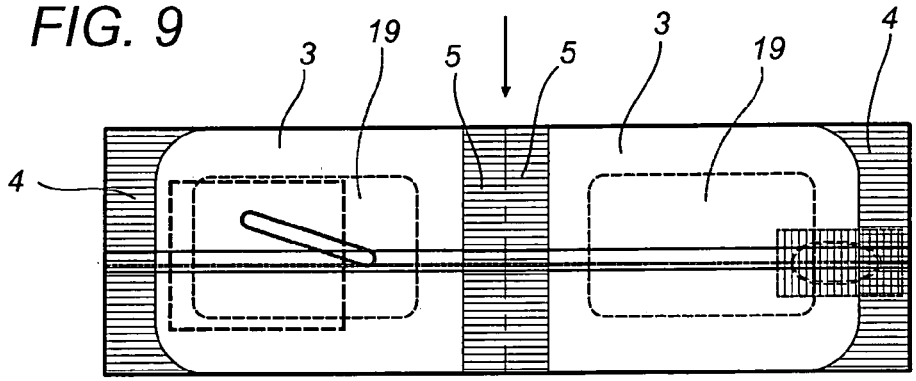

During a subsequent step in the process, schematically illustrated in FIG. 9, sections comprising two adjacent compartments 3 are cut and separated from the tube 34.

Figure 10:
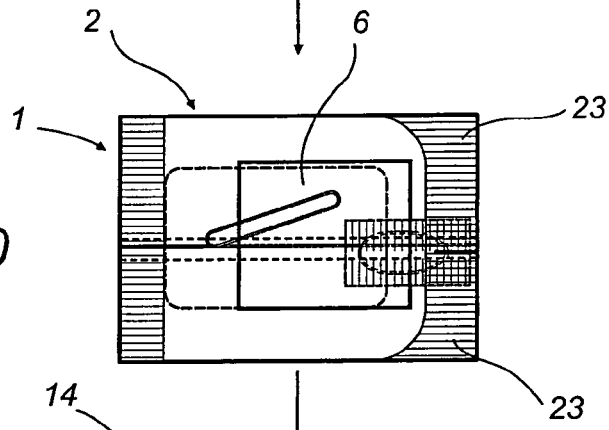
Figure 11:
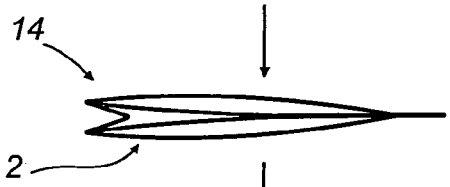

During the step schematically illustrated in FIG. 10, the two adjacent compartments 3 are folded over one another and at the same time an inverted "V" shape fold is made in the base 14 of the containment chamber 2.

Figure 12:
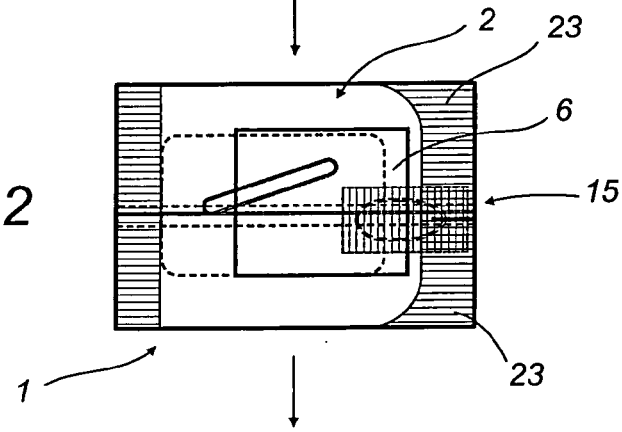
Figure 13:
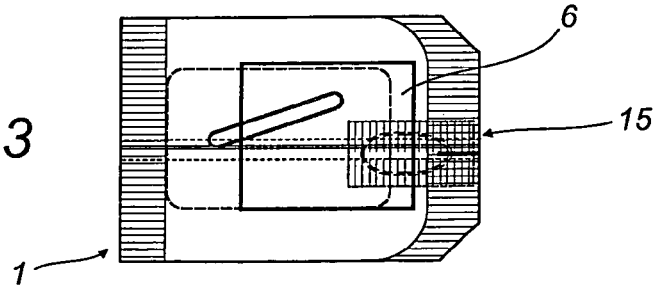

Following sealing of the top, illustrated in FIG. 12—where the compartments 3 are attached to one another to form a single-piece top 15 of the containment chamber 2, in a subsequent step illustrated in FIG. 13 the corners 23 of the top 15 of the filter bag 1 are cut off.

The invention described can be subject to modifications and variations without thereby departing from the scope of the inventive concept. Moreover, all the details of the invention may be substituted by technically equivalent elements.

What is claimed is:

1. A method for producing a filter bag for containing a substance for infusion in a liquid, said method comprising:

feeding in a predetermined feed direction and parallel with one another: a filter paper web, a cotton thread positioned longitudinally to and opposite the filter paper web and a succession of tags, the tags being placed along the web at predetermined intervals;

forming on the thread a succession of first winding loops, separated by an interval corresponding to the tag interval;

connecting the first winding loops of thread to the pick-up tags, and connecting the pick-up tags to the paper web;

folding the filter paper web over itself in a direction away from the thread and tag so that longitudinal edges of the filter paper web which were initially opposite one another are overlapping, gradually forming a filter paper tube in which the thread and tag are on the outside of said tube;

depositing a succession of doses of the substance for infusion on the web, before the tube is definitively formed;

connecting the longitudinal edges of the tube to one another;

making pairs of transverse connections on the tube, upstream and downstream of each tag, designed to delimit a succession of sealed containment chambers containing at least one dose of the substance for infusion;

securing the sections of thread between the transverse connections to the tube;

cutting the filter paper web at a predetermined distance from one of said pickup tags to form a slit; and, forcing the thread through the slit to form a second loop projecting from the filter paper web on a side opposite that in contact with the thread.

2. The method according to claim 1, in which the filter paper web has a layer of heat-activated adhesive material, wherein the connection of the longitudinal edges of the tube is made by heat-activation of the layer of adhesive material on the web.

3. The method according to claim 1, in which the filter paper web has a layer of heat-activated adhesive material, wherein the pairs of transverse connections are created by heat-activation of the layer of adhesive material on the web.

4. The method according to claim 1, in which the filter paper web has a layer of heat-activated adhesive material, wherein the step of securing the sections of thread between the connections to the tube is done by heat-activation of the layer of adhesive material.

5. The method according to claim 1, in which the pick-up tag comprises two flaps which can be folded over one another, wherein the first loop is attached to the pick-up tag at one flap of the tag, the method comprising a folding step in which the second flap of the tag is placed so that it overlaps the first loop and is connected to the first flap of the tag.

6. The method according to claim 5, in which the pick-up tag has a layer of heat-activated adhesive material, wherein the flaps are connected to one another by heat-activation of the adhesive material.

7. The method according to claim 5, further comprising a step in which the tag is creased to form a fold line for facilitated folding of one flap relative to the other.

8. The method according to claim 2, wherein the step of attaching the pick-up tag to the filter paper tube is performed by heat-activation of the layer of adhesive material.

9. The method according to claim 1, wherein during formation of the tube the second loop is housed in a concave section of the web.

10. The method according to claim 1, further comprising a sealing step in which the second loop and the filter paper web are attached to one another.

11. The method according to claim 10, wherein the step of sealing the second loop to the filter paper web takes place before the tag is sealed to the filter paper web.

12. The method according to claim 2, in which the containment chamber is divided into two adjacent compartments, further comprising a step of folding the compartments so that they overlap one another and the thread is wound around the overall outline of the containment chamber so that the tag and first loop connected to it are located on an outer face of the overall containment chamber; and a step of uniting the top joins of the tubular compartments to form a single top of the filter bag containment chamber.

13. The method according to claim 12, wherein the step of uniting the top joins of the containment chamber is performed by sealing by heat-activation of the layer of adhesive material on the filter paper.

14. The method according to claim 1, further comprising a cutting step in which the corners of the tops of the containment chambers are removed from the bag.

* * * * *